United States Patent [19]

Bau

[11] 4,254,979

[45] Mar. 10, 1981

[54] SCOOP DEVICE

[76] Inventor: Marcel Bau, 89 Van Ness Ct., Maplewood, N.J. 07040

[21] Appl. No.: 935,716

[22] Filed: Aug. 21, 1978

[51] Int. Cl.[3] ..... A01K 25/00

[52] U.S. Cl. ..... 294/1 BA; 294/19 A

[58] Field of Search ..... 294/19 R, 1 R, 55, 50.6, 294/50.7, 50.8, 55, 100; 15/104.8, 257.1, 257.4, 257.7; 56/328 R, 332; 150/3, 11; 119/1 R; 248/95, 99

[56] References Cited

U.S. PATENT DOCUMENTS 4,135,750 1/1979 Rosin ..... 294/1 BA

*Primary Examiner*—James B. Marbert

*Attorney, Agent, or Firm*—Kirschstein, Kirschstein, Ottinger & Cobrin

[57] ABSTRACT

A scoop device comprises a plurality of spring fingers, a string threaded through the ends of said fingers so as to form a polygon-shaped loop, and means for bringing the finger ends together by pulling the string to tighten the loop, such pulling being preferably effected by the upward movement of a sliding member to which is attached a pair of string segments threaded through one of said finger ends. A disposable bag placed between the spread spring fingers with its opening folded over said loop may then be placed over refuse which is scooped up by tightening the loop. The sliding member can then be kept locked in its uppermost position, corresponding to loop closure, and thereafter released to dispose of the bag with its contents. The same device, with or without a bag, may be used to pick up and throw a ball in a new type of sport.

3 Claims, 10 Drawing Figures

SCOOP DEVICE

BACKGROUND OF THE INVENTION

This invention relates to devices for scooping up various forms of refuse, especially animal waste, and also other types of objects such as a ball in new types of sports.

Although various devices have been invented for the purpose of retrieval of animal waste deposits and for related purposes, each of these devices appears to have some shortcomings in practicl use or cost of manufacture.

SUMMARY OF THE INVENTION

It is therefore a purpose of my invention to provide a scoop device which is both effective and convenient to use.

It is also a purpose of my invention to proivde a scoop device that is easy to manufacture in large quantities and hence inexpensive to the ultimate user.

It is a further object of my invention to provide a device for scooping up and thereafter throwing a ball in a new type of sport.

Briefly, my scoop device consists of a plurality of spring fingers affixed to the end of a cane-like handles, a string threaded through the lower ends of said fingers forming a polygon-shaped loop, and means for bringing said finger ends together by pulling the string to tighten the loop.

BRIEF DESCRIPTION OF THE DRAWINGS

My invention may be best explained with the aid of the drawings in which:

FIGS. 5, 6, and 7 are schematic perspective views of a somewhat more elaborate embodiment of my invention in which handle 25 and telescoping tube 31 are assumed to be of transparent material for the purpose of perspicacity.

DESCRIPTION OF THE PREFERRED EMBODIMENTS

Figure 1A:
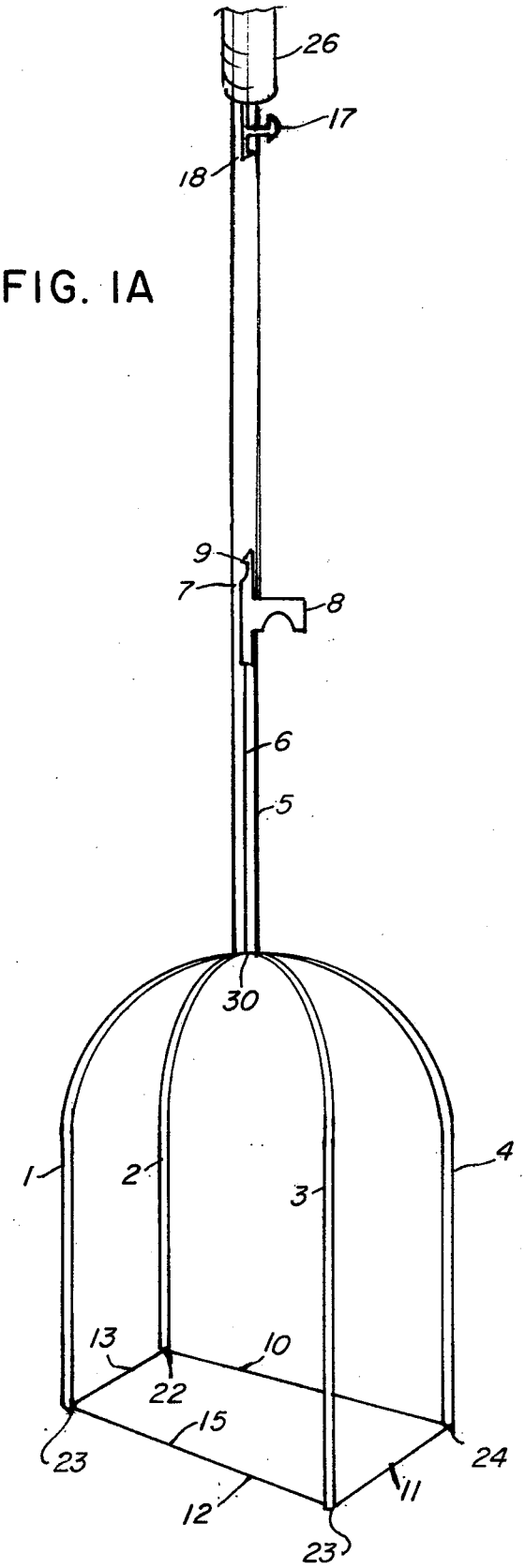
FIGS. 1A, 1B, 2, 3A and 3B are partial views in perspective of one preferred embodiment of my invention.
Figure 1B:
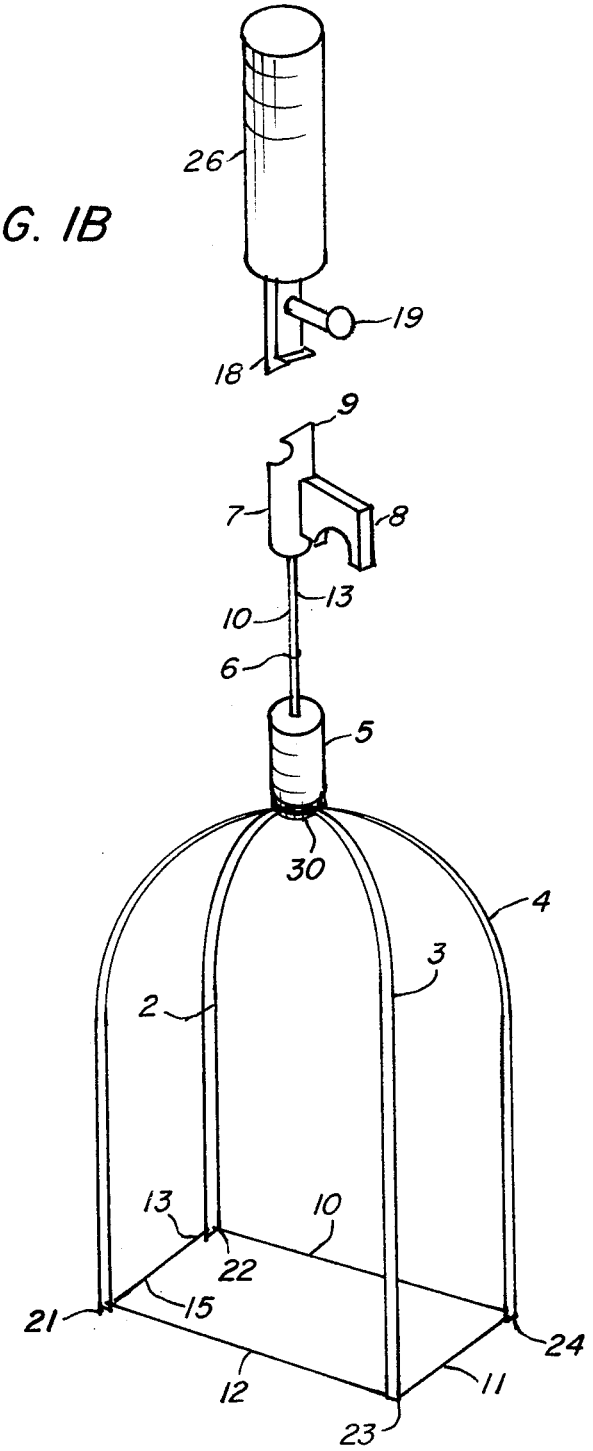
Figure 8:
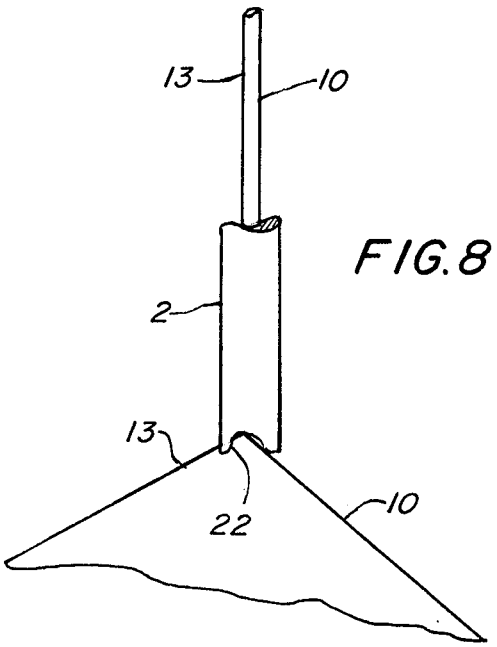
FIG. 8 is a perspective view of the threading of string segments 10 and 13 through the end portion of spring finger 2 in FIGS. 1A and 1B.

In the simpler embodiment of FIGS. 1 through 4, a lower portion of the scoop device is left exposed at all times. As shown in FIGS. 1A and 1B, a plurality of curved spring fingers 1,2,3,4 of approximately equal length, affixed to the lower end 30 of a tubular member 5 and spaced at approximately equal angles, have their lower ends 21,22,23,24 normally spread apart from each other. Each of these ends is perforated or bent into a small loop through which is threaded a string 6 whose segments 10,11,12,13 joining said ends form a substantially planar polygon-shaped loop 15. The two segments 10 and 13 adjacent to one of the spring fingers, say finger 2, are threaded alongside said finger 2 (FIG. 8) all the way through the inside of the lower portion of tubular member 5 up to a sliding member 7 to which they are firmly attached.

Spring fingers 1,2,3,4 may be as few as three in number, but four or more are preferable. They may be made of curved strips of spring steel or of any other suitable springy material. The string 6 may be made of fishing twine, wire, nylon thread or any other suitable plastic or other fibrous material.

Figure 4:
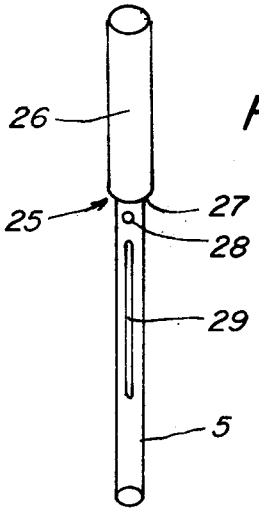
FIG. 4 is a perspective view of one type of handle 25 of FIGS. 1A through 3B.

As shown in FIG. 4, the tubular member 5 may form part of a handle 25, which may be made of a plastic material, wood, metal or any other suitable material or combination of materials. Whereas the major lower portion of handle 25 is in the form of a hollow cylinder, its upper or gripping portion 26 is preferably in the form of a solid rod, either straight as in a racket or bent as in a cane. Below the juncture 27 of the solid and hollow portions of handle 25 is a perforation 28 within tubular member 5, and somewhat further below is a vertical slit 29 whose length is approximately equal to half the maximum perimeter of loop 15.

Sliding member 7 may consist of a piece of cylindrical rod fitting snugly but not tightly within tubular member 5 and affixed to a narrow trigger-like extension 8 passing through the vertical slit 29 of tubular member 5. An upper hook-like portion 9 of sliding member 7 can be made to engage a catch means 18 of the gripping portion 26 so as to lock sliding member 7 in its uppermost position. This is effected by raising extension 8 to its uppermost position while simultaneously pressing a button 19 protruding from catch means 18 through hole 28 so as to push the catch means out of the way of hook-like portion 9, and then releasing button 19 thereby permitting catch means 18 to engage hook-like portion 9 so as to lock the sliding member 7. To disengage the elements 9 and 18, button 19 is again pressed, whereupon hook-shaped portion 9 is pulled down by the distention of spring fingers 1,2,3,4.

Figure 2:
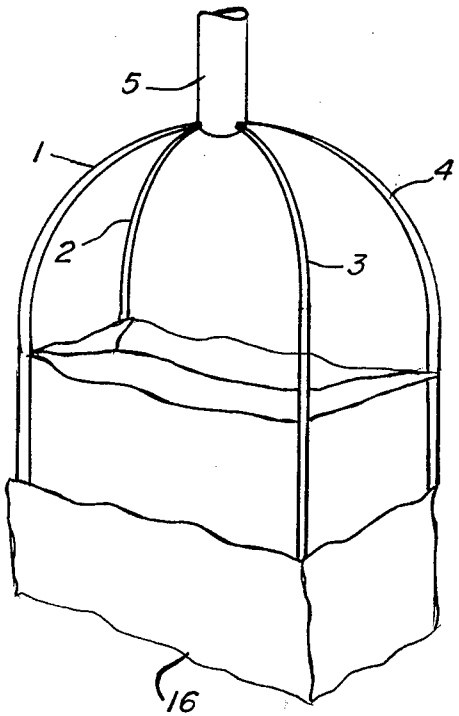
Figure 3A:
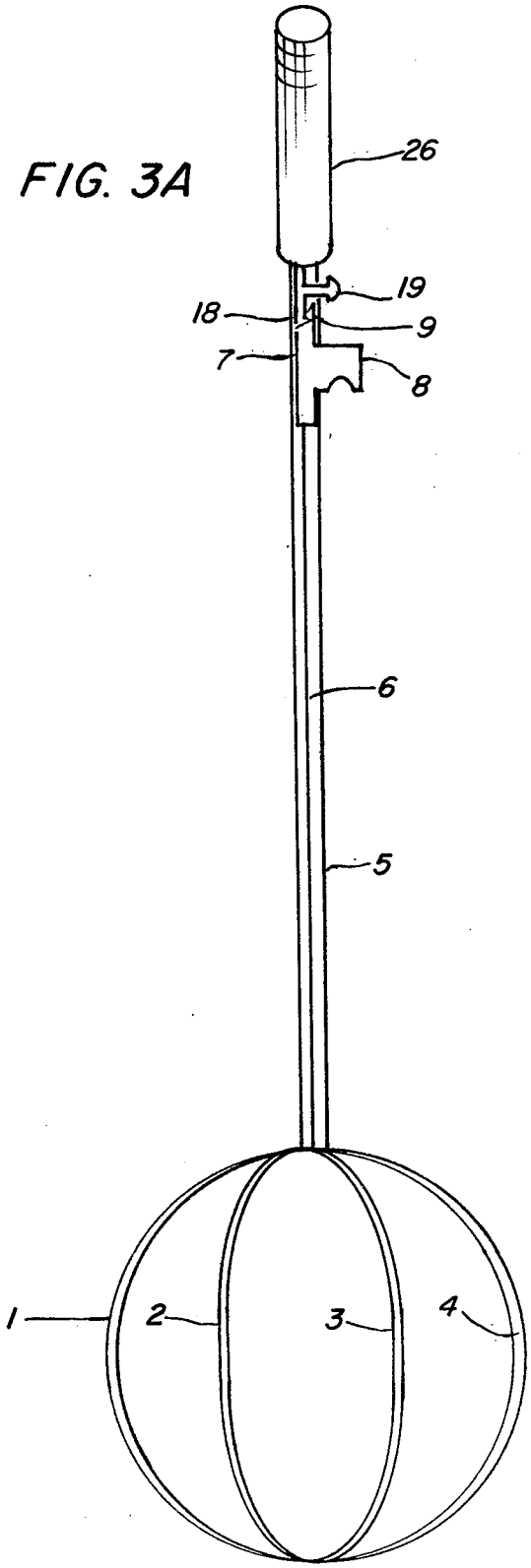
Figure 3B:
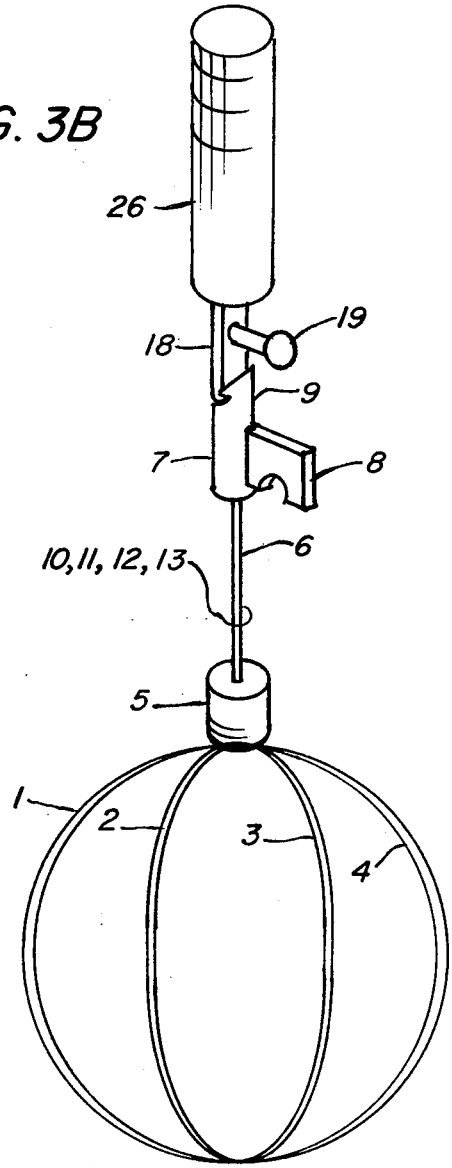

To obtain the configuration of FIGS. 1 and 2, the extension 8 of sliding member 7 is allowed to slide down to the lower end of slit 29. Prior to collection of debris or other refuse, a disposable bag 16 is placed upside down within the space defined by spring fingers 1,2,3,4 and the loop 15, with its open end portion folded inside out like a cuff over loop 15, as shown in FIG. 2. The bag opening is then placed over the refuse, and loop 15 is tightened by raising extension 18 to its uppermost position, whereby first the string segments 10 and 13 and thereafter most of the remaining segments 11, 12 are pulled up alongside spring finger 2 into tubular member 5. The spring fingers thereupon assume the closed configuration of FIGS. 3A and 3B.

Once the debris or other refuse is trapped within bag 16 by the closure of the spring fingers, the sliding member 7 may be locked in its uppermost position, corresponding to full closure, until a refuse collector (i.e., trash can, waste basket or the like) is encountered. Thereupon, button 19 may be depressed so as to (unlock sliding member 7 and) permit the spring fingers to return to their normal open position and allow bag 16 and its contents to drop into the refuse collector.

In the somewhat more elaborate embodiment of FIGS. 5 through 7, the scoop device may be given the appearance of a strolling cane by having a telescoping tube 31 slide down from over the lower end of tubular member 5 so as to enclose the spring fingers (thereby also protecting them from accidental damage), as shown in FIG. 5. Since the ends of these spring fingers are thereby brought closer together, the telescoping tube 31 may either have extend sufficiently far below the ends of the spring fingers to also cover any sagging loosened string segments 10, 11, 12, 13 or else the latter segments may be rendered taut by raising and locking sliding member 7 in an appropriate intermediate position (now shown). Alternatively, the bag 16 may first be placed between the spring fingers and over loop 15, as in FIG. 2, and telescoping tube 31 may thereafter be slid down over the spring fingers, including the bag, with the outer cuff-like portion of the bag tucked inside tube 31 serving to retain the loose string segments 10, 11, 12, 13 within tube 31.

When it is desired to pick up debris or other refuse, tube 31 is moved upward so as to allow spring fingers 1, 2, 3, 4 to spread and string segments 10, 11, 12, 13 to stretch and assume the configuration of FIG. 6. With the bag already in place, the lower portion of the scoop device will then have an appearance resembling that of FIG. 2, except that the tubular member 5 will be partly covered by telescoping tube 31.

To effect closure, the trigger-like extension 8 may again be raised to its uppermost position and locked in place by depressing and releasing button 19, as in the first-disclosed embodiment. The spring fingers will then assume the closed configuration of FIG. 7. Alternatively, the raising of extension 8 may be effected by lifting the telescoping tube 31 to a third position (not shown) and locking the tube in that position.

When a refuse collector is reached, the upper lock is disengaged, whereby the spring fingers are allowed to stretch (and to pull the sliding member 7 and its extension 8) back to the configuration of FIG. 6. The bag and its contents can then be dropped into the refuse collector.

Although both of the preceeding embodiments are directed primarily to devices for picking up debris or other refuse, it should be clear that the same type of device, with or without a permanent bag folded over loop 15, might be used in sports for picking up a ball and for throwing the ball by swinging the handle 25 like a racket while simultaneously depressing the button 19 so as to release the spring fingers and open loop 15, thereby permitting said ball to escape.

There will now be obvious to those skilled in the art many variations and modifications of the afore-disclosed embodiments, which, however, will not deviate from the scope of my invention if defined by the following claims:

I claim:

1. A scoop device comprising at least three fingers extending downwardly and outwardly from their upper ends which are adjacent one another, at least the tips of each of said fingers being bendable inwardly, means providing openings in the tips of said fingers, a string threaded through said openings to form a polygon-shaped loope, and means for tightening said loop by pulling sad string, thereby bringing said finger ends together.

2. The scoop device of claim 1 wherein the tightening of said loop is effected by pulling on a pair of string segments adjacent to one of said finger ends.

3. The scoop device of claim 2, comprising a tubular member to whose end is affixed the upper end of each of said fingers, and a sliding member to which said pair of string segments is attached, and which is free to slide withint said tubular member so that its upward movement causes a pulling action on said pair of string segments and hence a tightening of said loop.

* * * * *